US006334305B1

(12) United States Patent
Poggio et al.

(10) Patent No.: US 6,334,305 B1
(45) Date of Patent: Jan. 1, 2002

(54) SELF-ADAPTING METHOD FOR CONTROLLING TITRE IN AN INJECTION UNIT FOR AN INTERNAL COMBUSTION ENGINE

(75) Inventors: Luca Poggio, Spinetta Marengo; Marco Secco, Nizza Monferrato, both of (IT)

(73) Assignee: Magneti Marelli S.p.A., Milan (IT)

( * ) Notice: Subject to any disclaimer, the term of this patent is extended or adjusted under 35 U.S.C. 154(b) by 0 days.

(21) Appl. No.: 09/558,171

(22) Filed: Apr. 26, 2000

(30) Foreign Application Priority Data

Apr. 28, 1999 (IT) ..... BO99A0197

(51) Int. Cl.[7] ..... F01N 3/00
(52) U.S. Cl. ..... 60/274; 60/285
(58) Field of Search ..... 60/274, 285

(56) References Cited

U.S. PATENT DOCUMENTS

| | | | | |
|---|---|---|---|---|
| 4,850,324 A | | 7/1989 | Furuyama | |
| 4,947,818 A | | 8/1990 | Kamohara et al. | |
| 5,307,625 A | | 5/1994 | Junginger et al. | |
| 5,341,641 A | * | 8/1994 | Nakajima et al. | 60/274 |
| 5,359,852 A | | 11/1994 | Curran et al. | |
| 5,361,582 A | | 11/1994 | Uchida et al. | |
| 5,598,702 A | | 2/1997 | Uchikawa | |
| 5,600,948 A | * | 2/1997 | Nakajima et al. | 60/285 |
| 5,901,552 A | * | 5/1999 | Schnaibel et al. | 60/285 |
| 5,966,930 A | * | 10/1999 | Hatano et al. | 60/277 |
| 6,003,308 A | * | 12/1999 | Tsutsumi et al. | 60/285 |
| 6,062,019 A | * | 5/2000 | Staufenberg | 60/285 |
| 6,161,376 A | * | 12/2000 | Uchikawa | 60/285 |

FOREIGN PATENT DOCUMENTS

EP 0596635 5/1994

OTHER PUBLICATIONS

EPO Search Report 00 10 8954 (Aug. 2000) (Partial and Annex Reports).
EPO Search Report 00108954 (09/00) (Including Annex).
Patent Abstracts of Japan; Publication No.: 03151544; Inventor Kashiwanuma Nobuaki; Publication Date: Jun. 27, 2001.
Patent Abstracts of Japan; Publication No.: 04112939; Inventor Furuya Junichi; Publication Date: Apr. 14, 1992.

* cited by examiner

*Primary Examiner*—Thomas Denion
*Assistant Examiner*—Diem Tran
(74) *Attorney, Agent, or Firm*—Hall, Priddy, Myers & Vande Sande

(57) ABSTRACT

A self-adapting method for controlling titre for an internal combustion engine provided with a first and a second sensor of stoichiometric composition disposed respectively upstream and downstream of a system for reducing pollutant emissions and generating respective upstream and downstream composition signals. The method comprises the stages of determining a correction coefficient as a function of the upstream composition signal, the downstream composition signal and an objective signal indicative of an objective exhaust titre, determining an operating quantity of fuel to be injected into each cylinder of the engine as a function of the correction coefficient, memorising a plurality of current values of an adaptation signal each associated with a respective combination of values of the number of revolutions and the load of the engine, updating the current values as a function of the downstream composition signal, on each engine cycle, selecting one current value corresponding to the number of revolutions and the load of the engine in this engine cycle, generating the adaptation signal as a function of the current value selected and determining the correction coefficient also as a function of the adaptation signal.

14 Claims, 6 Drawing Sheets

SELF-ADAPTING METHOD FOR CONTROLLING TITRE IN AN INJECTION UNIT FOR AN INTERNAL COMBUSTION ENGINE

The present invention relates to a self-adapting method of controlling titre in an injection unit for an internal combustion engine.

BACKGROUND OF THE INVENTION

As is known, the majority of vehicles commercially available at present are fitted with injection units provided with systems for controlling titre which are adapted to regulate the quantity of fuel to be supplied to each individual cylinder in order to obtain an exhaust titre which is as close as possible to an objective titre.

Some of these control systems are of the self-adapting type, i.e. they are able to offset the output dispersions that cause the engine and the exhaust unit to move away from the nominal case set at the time of calibration and also partially to offset variations due to the ageing of the components of the engine and the exhaust unit, in particular the oxygen sensors and the catalytic system.

Control systems are known, for instance, which comprise a first and a second oxygen sensor disposed respectively upstream and downstream of the catalytic system. The information supplied by the sensor disposed upstream of the catalytic system is used to calculate a correction coefficient for a theoretical quantity of fuel to be injected into each cylinder such that the titre output from the combustion chamber, upstream of the catalytic system, is equal to an objective titre, while the information supplied by the sensor disposed downstream of the catalytic system is used to apply further corrections to the control parameters calculated on the basis of the information supplied by the sensor upstream of the catalytic system. On the basis of the information from the sensor disposed downstream of the catalytic system, an additional coefficient may in particular be calculated which modifies the value of the objective titre.

These known solutions have, however, a drawback due to the intrinsic slowness of adaptation and do not make it possible to obtain information on the functional nature of the injection control system, in particular on the oxygen sensors, which can be obtained only by using further sensors.

SUMMARY OF THE INVENTION

The object of the present invention is to provide a method which is free from the above-mentioned drawbacks and which, in particular, enables high-speed adaptation.

The invention therefore relates to a self-adapting method of controlling titre for an internal combustion engine 2 provided with a system for reducing pollutant emissions 4 and first and second sensor means of stoichiometric composition 5 disposed respectively upstream and downstream of this system for reducing pollutant emissions 4 and adapted to generate an upstream composition signal $V_1$ and respectively a downstream composition signal $V_2$, this method comprising the stages of:

determining a correction coefficient $KO_2$ as a function of the upstream composition signal $V_1$, the downstream composition signal $V_2$ and an objective signal V° indicative of an objective exhaust titre;

a) determining an operating quantity of fuel $Q_F$ to be injected into each cylinder of the engine 2 as a function of the correction coefficient $KO_2$;

characterised in that it further comprises the stages of:

b) storing a plurality of current values $V_{AC}(i, j)$ of an adaptation signal $V_A$, each associated with a respective combination of values of the number of revolutions RPM and the load L of the engine 2;

c) updating these current values $V_{AC}(i, j)$ as a function of this downstream composition signal $V_2$;

d) selecting, on each engine cycle, a current value $V_{AC}(i, j)$ corresponding to the number of revolutions RPM and the load L of the engine 2 in this engine cycle;

e) generating this adaptation signal $V_A$ as a function of the current value $V_{AC}(i, j)$ selected;

and in that the stage a) comprises the stage of:

al) determining the correction coefficient $KO_2$ also as a function of this adaptation signal $V_A$.

BRIEF DESCRIPTION OF THE DRAWINGS

The invention will now be described in further detail with reference to a preferred embodiment thereof, given purely by way of non-limiting example, made with reference to the accompanying drawings, in which.

DETAILED DESCRIPTION OF THE INVENTION

Figure 1:
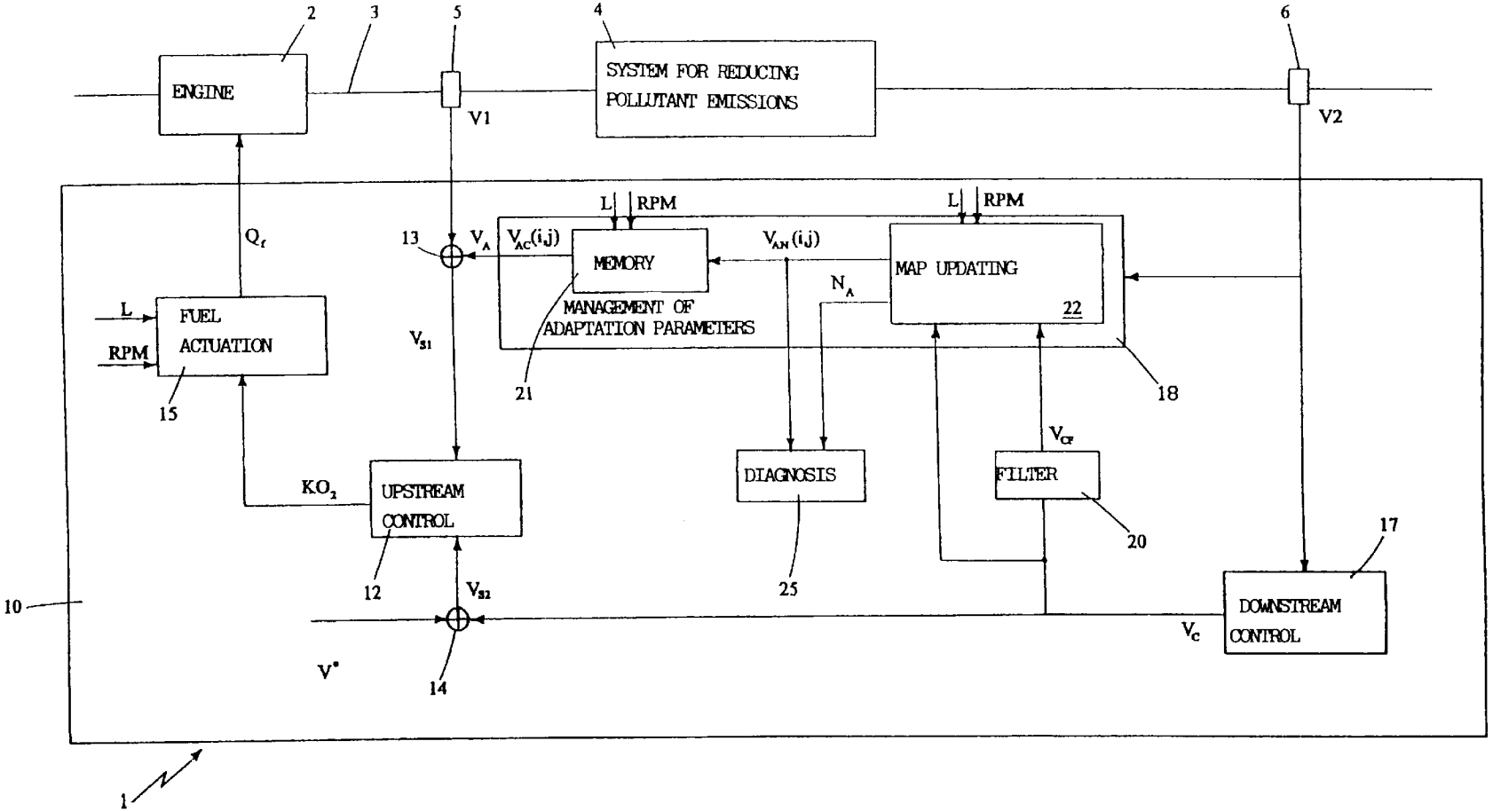
FIG. 1 is a diagram of a system for controlling titre of the present invention.

In FIG. 1, a system for controlling titre for an internal combustion engine 2 connected via an exhaust manifold 3 to a system for reducing pollutant emissions 4, typically comprising a pre-catalyst and a catalyst, is shown overall by 1.

A first sensor of stoichiometric composition of the exhaust gases, hereafter called the upstream sensor 5 and, respectively, a second sensor of stoichiometric composition of the exhaust gases, hereafter called the downstream sensor 6, are disposed upstream and downstream of the system for reducing pollutant emissions 4.

The sensors 5 and 6, which may conveniently be of the linear LAMBDA type, generate as output respective upstream and downstream composition signals $V_1$ and $V_2$ representative of the stoichiometric composition of the exhaust gases at the input and respectively the output of the system for reducing pollutant emissions 4.

The control system 1 further comprises a central unit 10 receiving as input the composition signals $V_1$ and $V_2$ and a plurality of engine-related parameters and supplies as output, on each engine cycle, an actuation signal $Q_F$ representative of the quantity of fuel to be injected into each cylinder.

The central unit 10 in particular comprises a downstream control block 17 receiving as input the downstream composition signal $V_2$ and supplying as output, on each engine cycle, a correction signal $V_c$, a filter block 20 of the low-pass type receiving as input the downstream composition signal $V_2$ and supplying as output a filtered correction signal $V_{CF}$, and an adaptation parameter management block 18, receiving as input the downstream composition signal $V_2$, the correction signal $V_C$, the filtered correction signal $V_{CF}$, the number of revolutions RPM and the load L of the engine 2 and supplying as output an adaptation signal $V_A$.

The central unit 10 further comprises a first summing block 13 receiving as input the upstream composition signal $V_1$ and the adaptation signal $V_A$ and supplying as output a first sum signal $V_{S1}$ equal to the sum of the upstream composition signal $V_1$ and the adaptation signal $V_A$, a second summing block 14 receiving as input the correction signal $V_C$ and an objective signal V° representative of an objective titre λ° and supplying as output a second sum signal $V_{S2}$ equal to the sum of the correction signal $V_C$ and the objective signal Vo, an upstream control block 12 receiving as input the first and the second sum signals $V_{S1}$, $VS_2$ and supplying as output, on each engine cycle and in a known manner which is not therefore described in detail, a correction coefficient $KO_2$, and a fuel actuation block 15 receiving as input the correction coefficient $KO_2$ and a plurality of engine-related parameters, for instance the number of revolutions RPM and the load L of the engine and supplying as output, in a known manner which is not therefore described in detail, the actuation signal $Q_F$.

The adaptation parameter management block 18 comprises a memory 21 containing a map M and a block 22 for updating the map M operating according to an adaptation strategy described in detail below.

In particular, the updating block 22 receives as input the downstream composition signal $V_2$, the correction signal $V_C$, the filtered correction signal $V_{CF}$ and the number of revolutions RPM and the load L of the engine 2 and supplies as output a counter of adaptations performed $N_A$ and updated values $V_{AN}(i, j)$ used to update the map M stored in the memory 21 in the manner described in detail below.

The memory 21 receives as input the number of revolutions RPM and the load L of the engine 2 and the updated values $V_{AN}(i, j)$ and a respective current value $V_{AC}(i, j)$ is stored in the map M for each combination of the values of the number of revolutions RPM and the load L. On each engine cycle, on the basis of the values assumed by the number of revolutions RPM and the load L, a current value $V_{AC}(i, j)$ is selected and supplied as output to the memory 21 and defines the adaptation signal $V_A$ supplied by the adaptation parameter management block 18 in the current engine cycle.

The central unit 10 lastly comprises a diagnostic block 25 receiving as input the counter of adaptations performed $N_A$ and the updated values $V_{AN}(i, j)$ and supplying as output a plurality of signals to a system supervisor (not shown).

As described in further detail below, the diagnostic block 25 in particular applies a diagnostic algorithm based on the verification of the congruence of the composition signals $V_1$ and $V_2$ supplied by the sensors 5 and 6 and is consequently able to generate a signal of correct operation of the system for controlling titre 1 or an error signal.

As mentioned above, the map updating block 22 implements an adaptation strategy for the updating of the map M. This strategy, which will be described below with reference to FIGS. 2 to 5, is carried out for each engine cycle and is based on the curve of the downstream composition signal $V_2$, and the correction signal $V_C$. In particular, it is verified whether the downstream composition signal $V_2$ and the correction signal $V_C$ remain within a dead band BM defined about an objective downstream value $V_2°$ and, respectively, within a safety band BS defined about an objective correction value $V_C°$ as shown in FIGS. 6*a* and 6*c* respectively.

Figure 2:
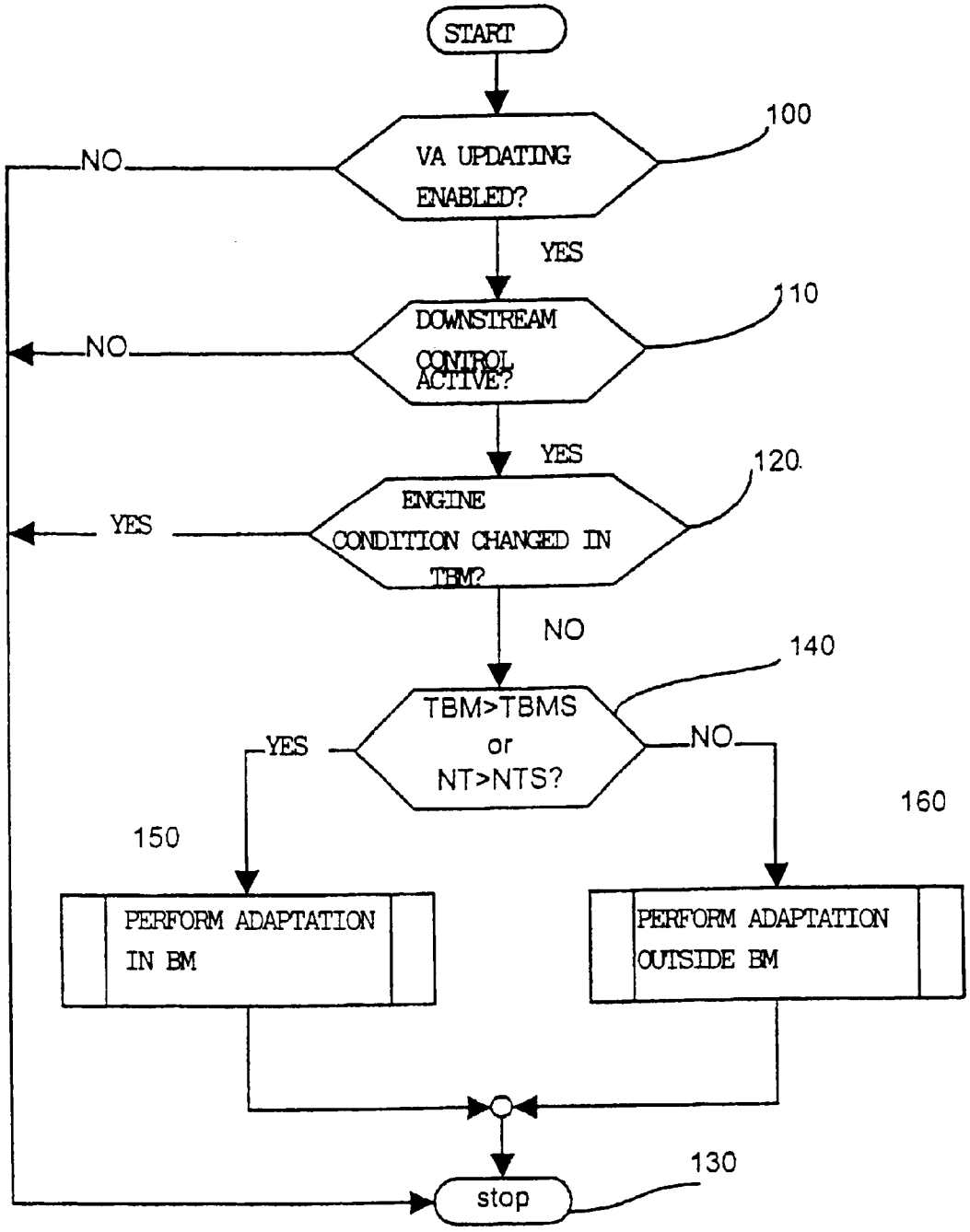
FIGS. 2 to 5 are flow diagrams of the control method of the present invention.

With reference to FIG. 2, a number of tests prior to the performance of the updating procedure are initially carried out in sequence. In detail, it is verified whether the updating function of the map M has been enabled during calibration (block 100), whether the downstream control block 17 is active (block 110) and whether the engine condition has remained unchanged with respect to the previous engine cycle (block 120). In all three cases, if the result of the check is negative, the updating procedure is abandoned (block 130), while if the result is positive, the successive test is conducted.

The test on the downstream control block 17 (block 110) is in particular carried out since this block may be temporarily disabled, for instance in the case of breakdown or particular operating conditions of the engine 2, while the test on the engine condition is carried out since the updating of the map M can be carried out only if the number of revolutions RPM and the load L remain stationary.

The presence of the system for reducing pollutant emissions 4 entails a delay of some tens of seconds between the variations of the compositions of the exhaust gases upstream and downstream of the system for reducing pollutant emissions 4 and it is therefore necessary to allow a transient to run its course.

If the result of the test on the engine condition is positive (block 120), a test is carried out on the permanence of the downstream composition signal $V_2$ within the dead band BM (block 140). This test consists in checking whether the downstream composition signal $V_2$ is currently within the dead band BM and, subsequently, whether at least one of the following two situations applies:

- the downstream composition signal $V_2$ has remained within the dead band BM continuously for a dead band time $T_{BM}$ greater than a threshold dead band time $T_{BMS}$, and
- the number of transitions NT that the downstream composition signal $V_2$ has performed with respect to the objective downstream value $V_2°$, without leaving the dead band BM, is greater than a threshold number of transitions $N_{TS}$.

If the result of the dead band permanence test (block 140) described above is positive, an adaptation procedure in the dead band BM is carried out (block 150), and in the opposite case an adaptation procedure outside the dead band BM is carried out (block 160).

Figure 3:
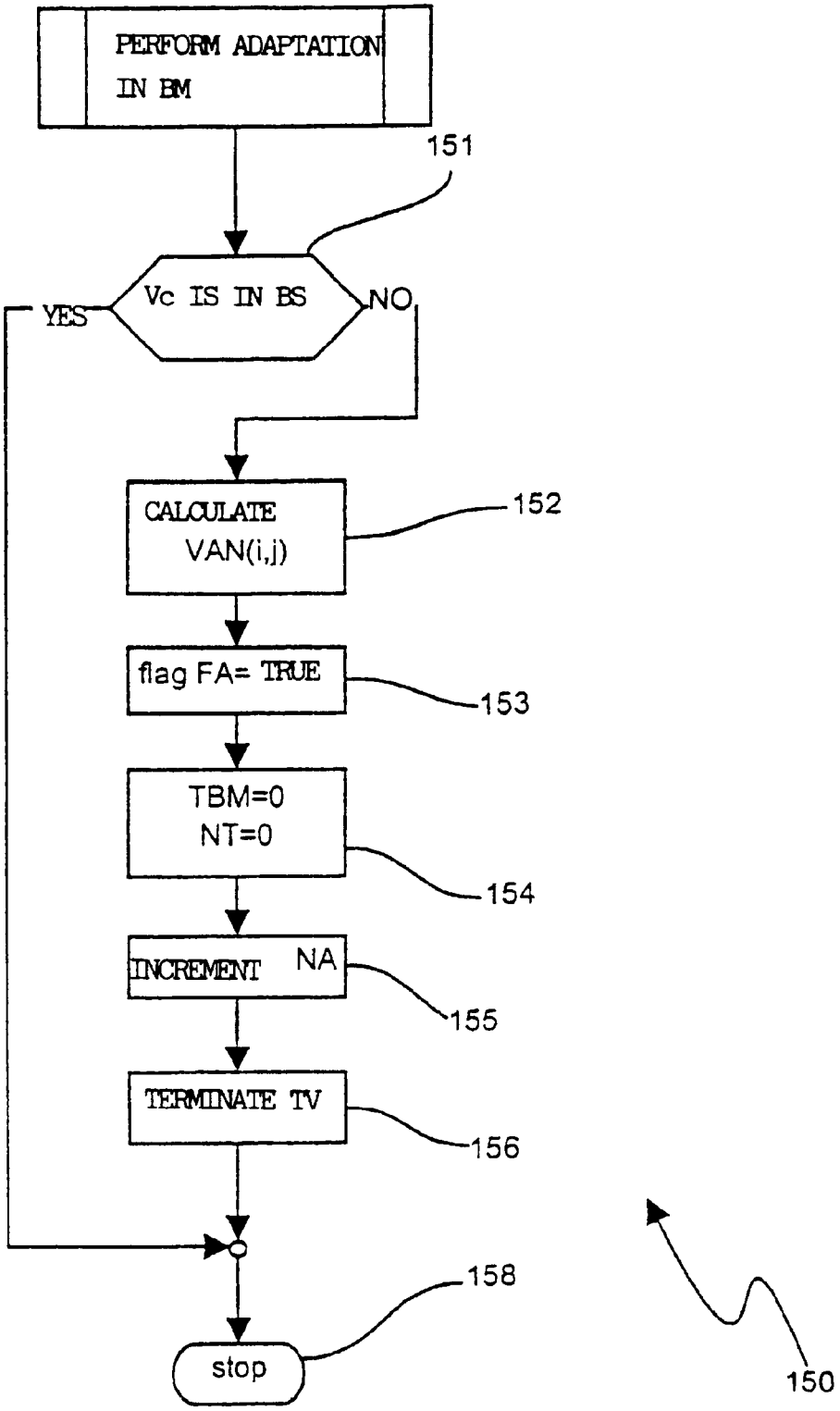

FIG. 3 is a block diagram relating to the adaptation procedure in the dead band BM (block 150).

As shown in this Figure, a test is initially conducted on the correction signal $V_C$ (block 151). Since the correction signal $V_C$ represents the action undertaken by the downstream control block 17 to maintain the downstream composition signal $V_2$ close to the objective downstream value $V_2°$, the test on the correction signal $V_C$ is intended to check whether, on the basis of the extent of this action, it is actually appropriate to carry out an updating of the map M.

Figure 6A:
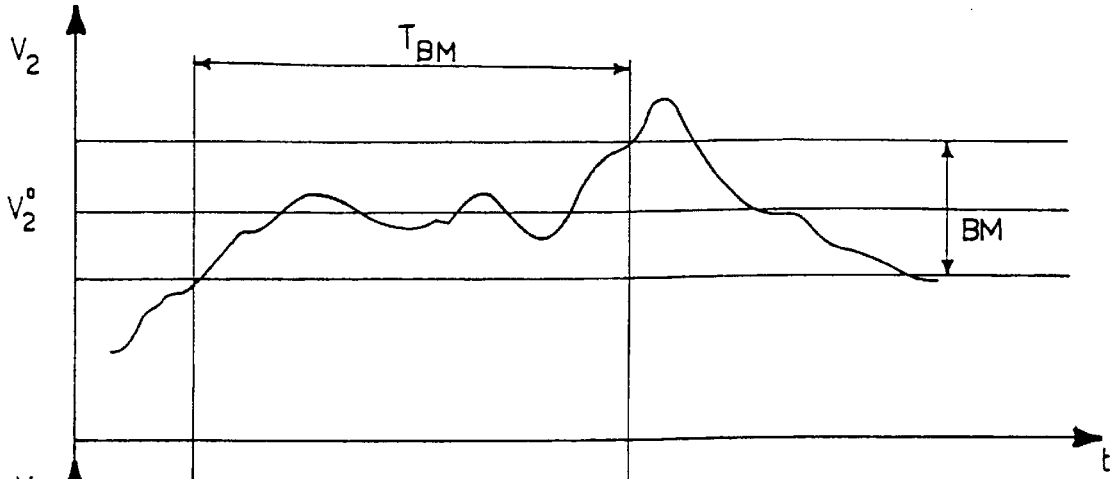
FIGS. 6*a* to 6*c* show examples of time curves of signals used in the method of the present invention.
Figure 6B:
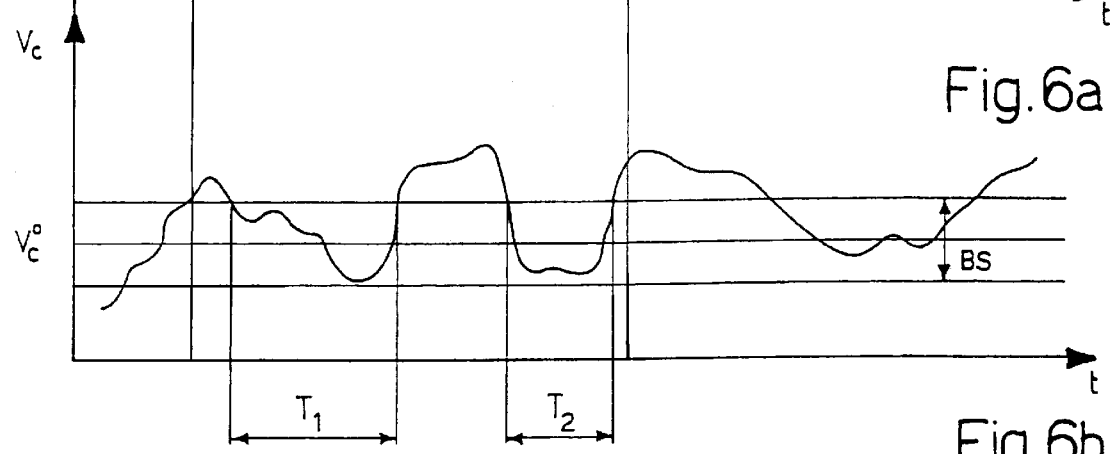

In particular, having defined a safety time band TBS as a sum of intervals $T_1, T_2, \ldots$, contained in the dead band time $T_{BM}$ during which the correction signal $V_C$ remains within the safety band BS (as shown in FIG. 6*b*), it is checked whether the ratio between the safety band time $T_{BS}$ and the dead band time $T_{BM}$ exceeds a first predetermined threshold $X_i$ between 0 and 1.

If the test result is positive, the updating of the map M is not deemed necessary and the updating procedure in the dead band BM is abandoned (block 158). In the opposite case, an updated value $V_{AN}(i, j)$ corresponding to the current conditions of load L and number of revolutions RPM of the engine 2 is calculated and stored in the memory 21 in place of the corresponding current value $V_{AC}(i, j)$ (block 152).

The calculation of the updated value $V_{AN}(i, j)$ is carried out by adding the current value of the filtered correction signal $V_{CF}$ to the current value $V_{AC}(i, j)$, i.e.:

$$V_{AN}(i, j)=V_{AC}(i, j)+V_{CF}.$$

All the other current values $V_{AC}$(i, j) corresponding to different conditions of load L and number of revolutions RPM of the engine 2 are left unchanged.

Subsequently, an adaptation flag $F_A$ is set at the logic value "TRUE" (block 153) to indicate that the adaptation procedure in the dead band BM has been carried out, the dead band time $T_{BM}$ and the number of transitions $N_T$ are zero-set (block 154) and the counter of adaptations performed $N_A$ is increased by one unit (block 155).

The number indicated by the counter of adaptations performed $N_A$ relates to the last period of engine ignition indicative of the time that has elapsed since the last starting of the engine 2.

Lastly, the counting of a downstream control time $T_V$ (block 156) indicative of the time that has elapsed since the last actuation of the downstream control block 17 is terminated and the adaptation procedure in the dead band BM is ended (block 158).

Figure 4:
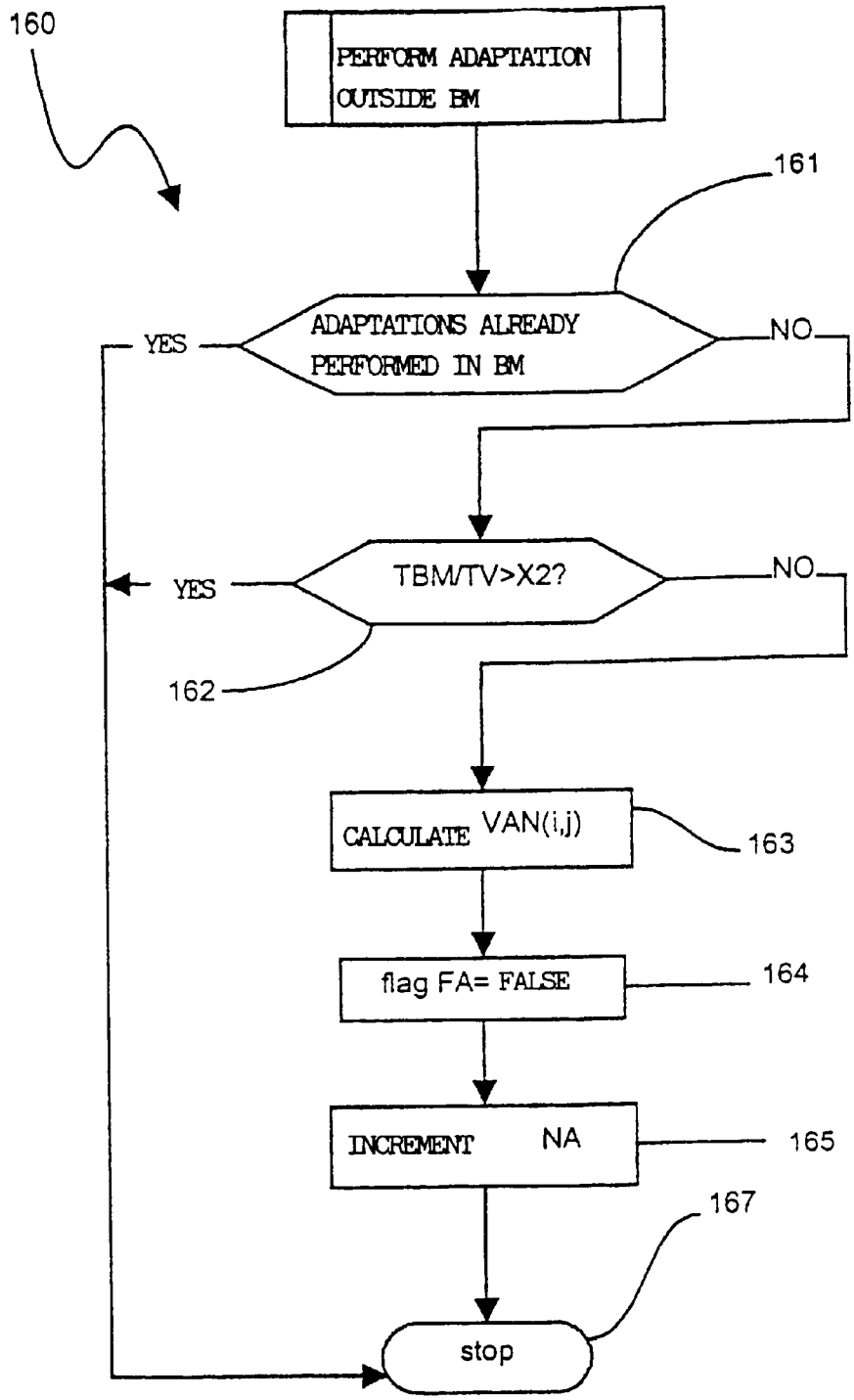

FIG. 4 is a block diagram relating to the adaptation procedure outside the dead band BM (block 160).

As shown in this Figure, a test is initially conducted to check whether an adaptation procedure in the dead band has already been carried out (block 161). If so, the adaptation procedure outside the dead band BM is abandoned (block 167). If not, a further test is carried out on a total dead band time $T_{BMT}$ (block 162), which is equal to the sum of the dead band times $T_{BM}$ included in the downstream control time $T_V$ (FIG. 6*c*)

In particular, it is checked whether the ratio between the dead band time $T_{BM}$ and the downstream control time $T_V$ exceeds a second predetermined threshold $X_2$ between 0 and 1. If so, the adaptation procedure outside the dead band BM is abandoned (block 167), otherwise the updated values $V_{AN}$(i, j) are calculated (block 163).

In practice, the map M is updated when the action of the downstream control block 17 is not sufficient to ensure the permanence of the downstream composition signal $V_2$ within the dead band BM for a minimum time from the actuation of this downstream control block 17. It is considered that the above-described situation is critical.

The calculation of the updated values $V_{AN}$ (i,j) is carried out using the following formula:

$$V_{AN}(i, j)=V_{AC}(i, j)+K_A*V_{CF}$$

in which $K_A$ is a correction coefficient between 0 and 1. This coefficient is introduced in order to attenuate the extent of the updating, since the adaptation procedure outside the dead band is used in conditions considered to be critical, as mentioned above. Moreover, the updating relates to all the values of the map M and not just to that value corresponding to the current conditions of number of revolutions RPM and load L of the engine 2.

Subsequently, the adaptation flag $F_A$ is set at the logic value "FALSE" (block 164) to show that the adaptation procedure outside the dead band BM has been performed and the counter of adaptations performed $N_A$ is increased by one unit (block 165), terminating the updating procedure outside the dead band BM (167).

Figure 5:
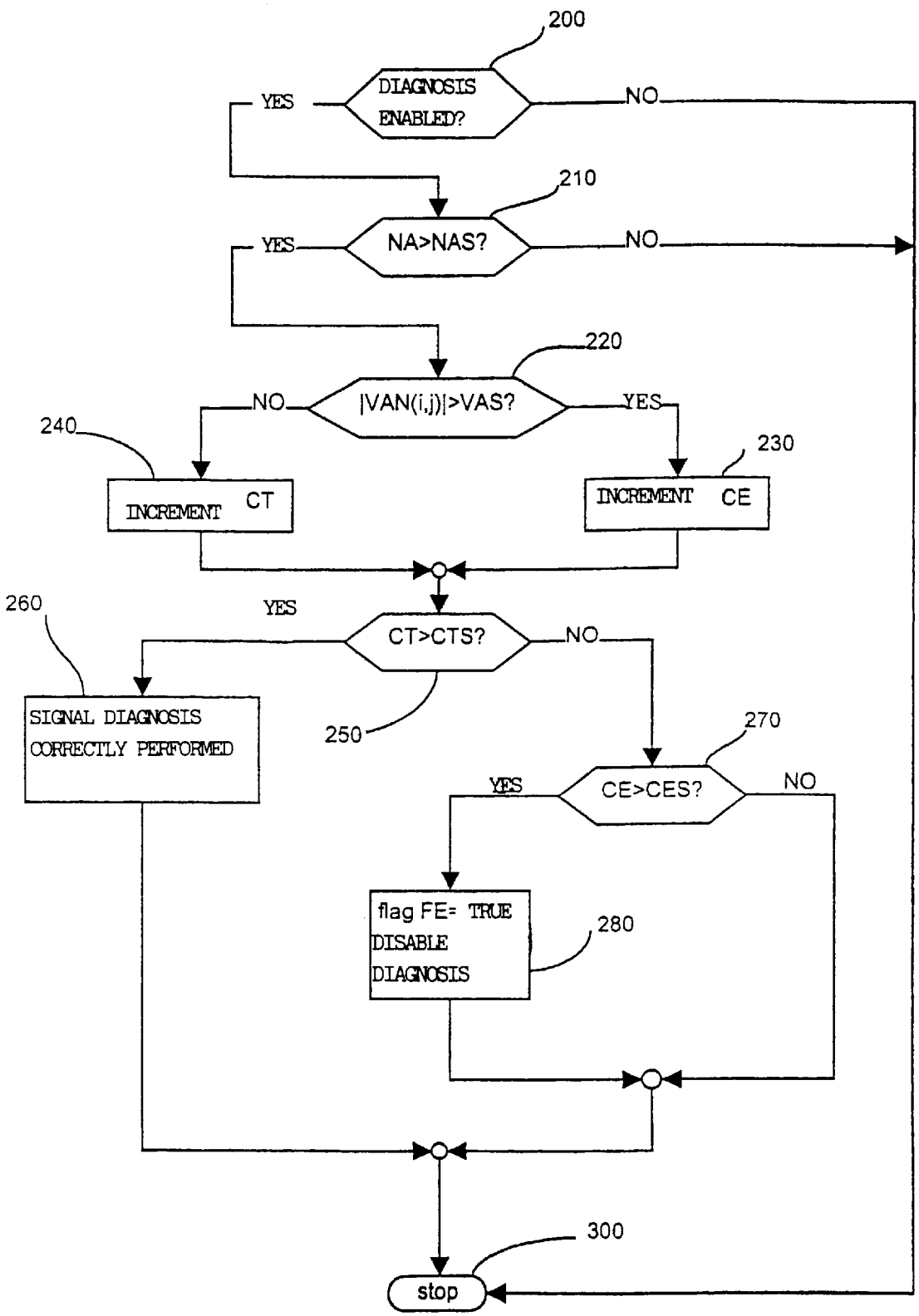
Figure 6C:
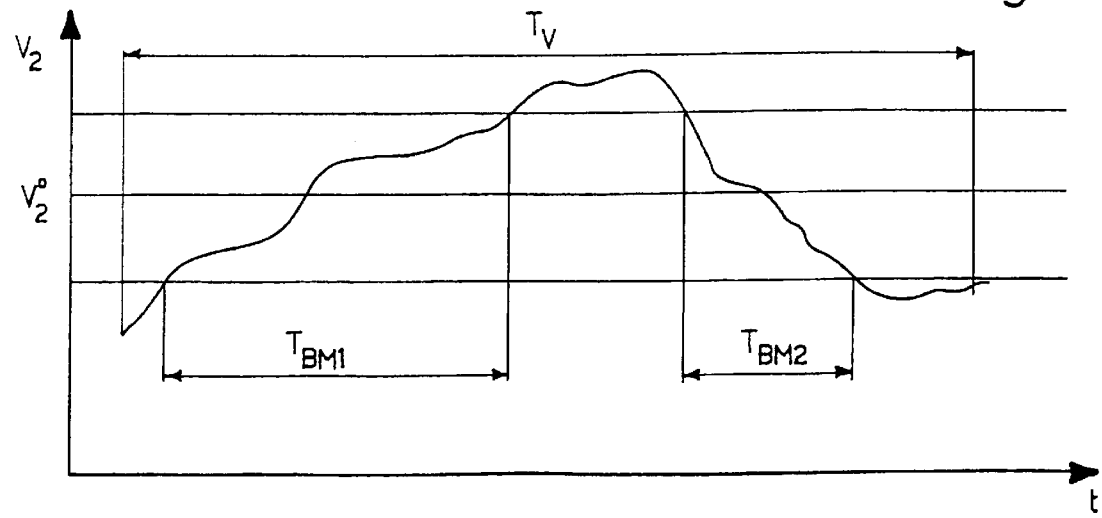

FIG. 5 is a flow diagram relating to the diagnostic algorithm applied by the diagnostic block 25.

As shown in this Figure, it is initially checked whether the diagnostic function has been enabled during calibration (block 200). If not, the diagnostic algorithm is terminated (block 300), otherwise it is checked whether a certain number of updatings of the map M has already been carried out (block 210).

In particular, if the counter of updatings performed $N_A$ is lower than a predetermined threshold value $N_{AS}$, the diagnostic algorithm is terminated (block 300), while in the opposite case a test is carried out on the absolute value of the updated values $V_{AN}$(i, j) (block 220) to check whether, for at least one combination of values of the number of revolutions RPM and the load L of the engine 2, the corresponding updated value $V_{AN}$(i, j) exceeds, as an absolute value, a predetermined adaptation threshold value $V_{AS}$. In practice, this is equivalent to considering that the storage in the map M of a value that is too high is a symptom of a lack of congruence between the signals detected by the upstream sensor 5 and the downstream sensor 6 and therefore that a situation of irregular operation has occurred.

If the condition is true for at least one updated value $V_{AN}$(i, j), an error counter $C_E$ is incremented (block 230), while in the opposite case a counter of positive tests performed $C_T$ is incremented (block 240).

A test is then carried out on the counter of positive tests performed $C_T$ (block 250). In particular, if this counter exceeds a predetermined threshold number of test counts $C_{TS}$, the system supervisor is informed that the diagnostic algorithm has been carried out correctly (block 260) and the diagnostic algorithm is terminated, while in the opposite case a test is carried out on the error counter $C_E$ (block 270).

If the error counter $C_E$ has exceeded a threshold number of error counts $C_{ES}$, an error message is sent to the system supervisor, for instance by setting an error flag $F_E$ to the logic value "TRUE" and the diagnostic block 25 is disabled (block 280), while in the opposite case the diagnostic algorithm is terminated.

In the block 280, a condition flag $F_S$ is also set to a logic value corresponding to an error signal, such that, when the engine 2 is next started, a stored value Δ is used to modify the values of the map M that exceed the adaptation threshold value $V_{AS}$. In particular, the value Δ is added to the above-mentioned values, if they are of negative sign; if, however, the sign is positive, the value Δ is subtracted. In this way, at the time at which the engine 2 is restarted, the values of the map M that have brought about the error signal are reset to less critical values; consequently, if the causes of the error are temporary and are removed by shutting down the engine 2, a condition of correct operation is reset when the engine is restarted.

If, however, the causes of the error remain, there will necessarily be a new malfunction signal.

The method described above has the following advantages. In the first place, through the updating of the coefficients $V_{AC}$(i, j) of the map M, it makes it possible to compensate both output dispersions and deviations from normal performance due to the ageing of the components forming the system.

Moreover, the method is able rapidly to calculate these coefficients; these coefficients are chosen, at each engine cycle, exclusively on the basis of the current conditions of number of revolutions RPM and load L.

A further advantage lies in the fact that the method makes it possible simply to conduct a diagnosis of the congruence of the information supplied by the sensors of stoichiometric composition without any need to use sensors of other types.

The diagnostic algorithm is also rapid; the element that has a preponderant impact on the time needed to calculate the coefficients $V_{AN}$(i, j) is the system for reducing pollutant emissions 4 which, as mentioned above, causes a delay of some tens of seconds between the variations of the upstream composition signal $V_1$ and the corresponding variations of the downstream composition signal $V_2$.

The only condition that is necessary for the conduct of the diagnosis is therefore the stationary nature of the operating conditions of the engine 2 for a sufficient period of time brought about by the system for reducing pollutant emissions 4.

It will be appreciated that modifications and variations that do not depart from the scope of protection of the present invention may be made to the method described above.

What is claimed is:

1. A self-adapting method of controlling titre for an internal combustion engine (2) provided with a system for reducing pollutant emissions (4) and first and second sensor means of stoichiometric composition (5, 6) disposed respectively upstream and downstream of this system for reducing pollutant emissions (4) and respectively adapted to generate an upstream composition signal ($V_1$) and a downstream composition signal ($V_2$), this method comprising the stages of:

a1) determining a correction coefficient ($KO_2$) as a function of the upstream composition signal ($V_1$), the downstream composition signal ($V_2$) and an objective signal (V°) indicative of an objective exhaust titre;

a2) determining an operating quantity of fuel ($Q_F$) to be injected into each cylinder of the engine (2) as a function of this correction coefficient ($KO_2$);

characterized in that it further comprises the stages of:

b) storing a plurality of current values ($V_{AC}$(i,j)) of an adaptation signal ($V_A$), each associated with a respective combination of values of the number of revolutions (RPM) and the load (L) of the engine (2);

c) updating these current values ($V_{AC}$(i,j)) as a function of the downstream composition signal ($V_2$);

d) selecting, on each engine cycle, a current value ($V_{AC}$(i,j)) corresponding to the number of revolutions (RPM) and the load (L) of the engine (2) in this engine cycle;

e) generating this adaptation signal ($V_A$) as a function of the current value ($V_{AC}$(i,j)) selected;

and that the stage a1) further comprises the stage of:

a11) determining the correction coefficient ($KO_2$) also as a function of this adaptation signal ($V_A$); and wherein stage c) is preceded by the stages of:

f) checking the permanence of this downstream composition signal ($V_2$) in a dead band (BM) (140);

g) carrying out an updating procedure in the dead band (150) when the permanence of the downstream composition signal ($V_2$) in this dead band (BM) has been verified;

h) carrying out an updating procedure outside the dead band (160) when the permanence of this downstream composition signal ($V_2$) in the dead band (BM) has not been verified.

2. A method as claimed in claim 1, characterised in that the dead band (BM) is formed by an interval of values assumed by the downstream composition signal ($V_2$) comprising an objective downstream composition value ($V_2$°).

3. A method as claimed in claim 1, characterised in that the stage f) comprises the stages of:

f1) determining a dead band time ($T_{BM}$) indicative of the time in which the downstream composition signal ($V_2$) has remained in this dead band (BM);

f2) determining a number of dead band transitions ($N_T$) indicative of the transitions made by the downstream composition signal ($V_2$) in this dead band (BM);

f3) checking whether this dead band time ($T_{BM}$) is greater than a threshold dead band time ($T_{BMS}$);

f4) checking whether this number of dead band transitions ($N_T$) is greater than a threshold number of dead band transitions ($N_{TS}$).

4. A method as claimed in claim 3, characterised in that the stage g) comprises the stages of:

g1) generating a correction signal ($V_C$ ) as a function of the downstream composition signal ($V_2$);

g2) checking the permanence of this correction signal ($V_C$) within a safety band ($B_S$) (151);

g3) when the permanence of this correction signal ($V_C$) within this safety band ($B_S$) has not been verified, calculating one of the updated values ($V_{AN}$(i, j)) as a function of this correction signal ($V_C$).

5. A method as claimed in claim 4, characterised in that the stage g3) comprises the stage of calculating one of the updated values ($V_{AN}$(i, j)) according to the formula:

$$V_{AN}(i, j)=V_{AC}(i, j)+V_{CF}$$

in which ($V_{AN}$(i, j)) is the updated value, ($V_{AC}$(i, j) ) is a corresponding corrected value and ($V_{CF}$) is a filtered correction signal obtained by filtering this correction signal ($V_C$).

6. A method as claimed in claim 4, characterised in that the safety band ($B_S$) is formed by an interval of values assumed by this correction signal (VC) comprising an objective correction value ($V_C$°).

7. A method as claimed in claim 4, characterised in that the stage g2) comprises the stages of:

g21) determining a safety band time ($T_{BS}$) correlated with the sum of the time intervals contained in the dead band time ($T_{BM}$) during which the correction signal ($V_C$) remains in this safety band ($B_S$);

g22) checking whether the ratio between the safety band time ($T_{BS}$) and the dead band time ($T_{BM}$) is greater than a first predetermined threshold ($X_1$).

8. A method as claimed in claim 3, characterised in that the stage h) comprises the stages of:

h1) checking the permanence of the downstream composition signal ($V_2$) outside the dead band (BM) (162);

h2) when the permanence of this downstream composition signal ($V_2$) outside the dead band (BM) has been verified, calculating all the updated values ($V_{AN}$(i, j)) as a function of the correction signal.

9. A method as claimed in claim 8, characterized in that the stage h2) comprises the stage of calculating all of the updated values ($V_{AN}$(i, j) ) according to the formula:

$$V_{AN}(i, j)=V_{AC}(i, j)+K_A*V_{CF}$$

in which ($V_{AN}$(i, j) ) are the updated values, ($V_{CF}$) is a filtered correction signal obtained by filtering this correction signal ($V_C$) and ($K_A$) is a correction coefficient.

10. A method as claimed in claim 9, characterised in that the correction coefficient ($K_A$) is between 0 and 1.

11. A method as claimed in claim 8, characterised in that the stage h1) comprises the stages of:

h11) determining a downstream control time ($T_V$) indicative of the time that has elapsed from the actuation of a downstream control block (17);

h12) checking whether the ratio between the dead band time (TBM) and this downstream control time ($T_V$) is greater than a second predetermined threshold ($X_2$).

12. A self-adapting method of controlling titre for an internal combustion engine (2) provided with a system for reducing pollutant emissions (4) and first and second sensor means of stoichiometric composition (5, 6) disposed respectively upstream and downstream of this system for reducing pollutant emissions (4) and respectively adapted to generate an upstream composition signal ($V_1$) and a downstream composition signal ($V_2$), this method comprising the stages of:

a1) determining a correction coefficient ($KO_2$) as a function of the upstream composition signal ($V_1$), the downstream composition signal ($V_2$) and an objective signal ($V°$) indicative of an objective exhaust titre;

a2) determining an operating quantity of fuel ($Q_F$) to be injected into each cylinder of the engine (2) as a function of this correction coefficient ($KO_2$);

characterized in that it further comprises the stages of:

b) storing a plurality of current values ($V_{AC}(i,j)$) of an adaptation signal ($V_A$), each associated with a respective combination of values of the number of revolutions (RPM) and the load (L) of the engine (2);

c) updating these current values ($V_{AC}(i,j)$) as a function of the downstream composition signal ($V_2$);

d) selecting, on each engine cycle, a current value ($V_{AC}(i,j)$) corresponding to the number of revolutions (RPM) and the load (L) of the engine (2) in this engine cycle;

e) generating this adaptation signal ($V_A$) as a function of the current value ($V_{AC}(i, j)$ ) selected;

and that the stage a1) further comprises the stage of:

a11) determining the correction coefficient ($KO_2$) also as a function of this adaptation signal ($V_A$); said method further comprising the stages of:

i) carrying out a diagnostic procedure to verify the correct operation of the first and second sensor means of stoichiometric composition (5,6) and of the system for reducing pollutant emissions (4) on the basis of updated values ($V_{AN}(i, j)$ i1) comparing absolute values of the updated values ($V_{AN}(i,j)$) with at least one adaptation threshold value ($V_{AS}$) (220);

i2) incrementing an error counter ($C_E$) (230) when at least one of the above absolute values of the updated values ($V_{AN}(i,j)$) is greater than this adaptation threshold value ($V_{AS}$);

i3) incrementing a counter of positive tests performed ($C_T$) (240) when all the absolute values of these updated values ($V_{AN}(i,j)$) are lower than this adaptation threshold value ($V_{AS}$).

13. A method as claimed in claim 12, characterised in that the stage i) further comprises the stages of:

i4) comparing this counter of positive tests performed ($C_T$) with a predetermined threshold number of test counts ($C_{TS}$);

i5) signalling a correct performance of the diagnostic procedure (260) when this counter of positive tests performed ($C_T$) is greater than this threshold number of test counts ($C_{TS}$);

i6) carrying out an error detection sequence (270, 280, 290) when the counter of positive tests performed ($C_T$) is lower than the threshold number of test counts ($C_{TS}$).

14. A method as claimed in claim 13, characterised in that the error detection sequence stage (270, 280, 290) comprises the stages of:

i61) comparing the error counter ($C_E$) with a predetermined threshold number of error counts ($C_{ES}$);

i62) generating an error signal ($F_E$) and disabling the diagnostic procedure, when the error counter ($C_E$) is greater than this predetermined threshold number of error counts ($C_{ES}$).

* * * * *